US010926580B1

(12) United States Patent
Galloway

(10) Patent No.: US 10,926,580 B1
(45) Date of Patent: Feb. 23, 2021

(54) APPARATUS AND METHOD FOR CLEANING A ROLLER BRUSH

(71) Applicant: Austra Lee Galloway, Augusta, GA (US)

(72) Inventor: Austra Lee Galloway, Augusta, GA (US)

( * ) Notice: Subject to any disclaimer, the term of this patent is extended or adjusted under 35 U.S.C. 154(b) by 0 days.

(21) Appl. No.: 16/946,318

(22) Filed: Jun. 16, 2020

(51) Int. Cl.
*B44D 3/00* (2006.01)
*B08B 3/02* (2006.01)
*B05C 17/02* (2006.01)

(52) U.S. Cl.
CPC ..... *B44D 3/006* (2013.01); *B05C 17/0245* (2013.01); *B08B 3/02* (2013.01); *B08B 2203/0211* (2013.01)

(58) Field of Classification Search
CPC ..... B44D 3/006
See application file for complete search history.

(56) References Cited

U.S. PATENT DOCUMENTS 2,296,080 A 9/1942 Arrowood
2,316,717 A 4/1943 Ries
2,873,830 A 2/1959 Wilt
2,918,997 A 12/1959 Kotkins
4,091,977 A 5/1978 Luttbeg
4,576,280 A 3/1986 Dove et al.
4,662,513 A 5/1987 King et al.
4,693,369 A 9/1987 Lagin
4,793,490 A 12/1988 Evert
5,005,598 A * 4/1991 Hodgdon ..... B44D 3/006 134/138
5,614,021 A * 3/1997 Catlin ..... B05C 17/035 118/258
6,220,411 B1 4/2001 Scicluna et al.
6,454,089 B1 9/2002 Pease
8,663,531 B2 3/2014 De Taeye et al.
2006/0213544 A1* 9/2006 Schmitt ..... B44D 3/006 134/184
2009/0145870 A1 6/2009 Tagawa et al.
2013/0001113 A1 1/2013 Levine
2016/0183651 A1 6/2016 Tonelli
2017/0000231 A1 1/2017 Jacobsen
2017/0347765 A1 12/2017 Jackson et al.

* cited by examiner

*Primary Examiner* — Jason Y Ko
(74) *Attorney, Agent, or Firm* — Dunlap Bennett & Ludwig, PLLC; Brendan E. Squire

(57) ABSTRACT

An apparatus and method for cleaning a paint roller. The apparatus includes a handle configured to communicate a cleaning solvent to a cleaning casement. The solvent is tangentially directed at a surface of a roller brush contained within the cleaning casement to impart a rotation of the paint roller to dissolve and release the paint or other coating composition from the paint roller. The cleaning casement may include a top casement segment and a bottom casement segment hingedly connected to enclose the roller brush. In use the roller brush may be inserted into the cleaning casement while attached to the roller handle assembly. Removed paint and solvent are collected through an exhaust.

10 Claims, 4 Drawing Sheets

APPARATUS AND METHOD FOR CLEANING A ROLLER BRUSH

BACKGROUND OF THE INVENTION

The present invention relates to coating applicator cleaners, and more particularly to a cleaning apparatus for roller applicator brushes.

Roller applicator brushes for coatings, such as paints, can be difficult to clean. In the case of water-based coatings, such as latex paints, the roller can take considerable quantities of water to thoroughly clean the coating that is contained within the nap of the roller brush head. Soaking in a bath of water requires multiple emptying and replenishment of the water in the bath. If residual coating material is retained within the nap, the roller brush head will need to be thrown away if the coating material hardens within the nap.

While a hose may be used to direct the water at the exterior surface of the roller, the residual coating may sling in an undirected manner leaving numerous spots in the area where the roller is being cleaned.

As can be seen, there is a need for an improved apparatus and methods for cleaning a roller brush applicator.

SUMMARY OF THE INVENTION

In one aspect of the present invention, a roller brush cleaning apparatus is disclosed. The roller brush cleaning apparatus includes a handle having a coupling at a first end. The coupling is configured to connect to a pressurized source of a cleaning solvent. An interior cavity is defined by at least one sidewall to communicate the cleaning solvent to a splayed end of the handle. A cleaning casement is coupled to the splayed end. The cleaning casement is configured to surround a roller brush for rotation of the roller brush within the cleaning casement. At least one jet spray nozzle is interposed between the splayed end and the cleaning casement. The at least one jet spray nozzle communicates the cleaning solvent from the splayed end into the cleaning casement. The at least one jet spray nozzle is oriented to tangentially direct the cleaning solvent against a circumferential aspect of the roller brush.

In some embodiments, a plurality of guide vanes may be provided to protrude into the interior cavity to direct the cleaning solvent across the splayed end of the handle.

In other embodiments, the cleaning casement includes a top casing segment and a bottom casing segment interconnected by a hinge element to selectively open and close the cleaning casement about the roller brush.

In other embodiments, an end wall is defined at a first end of the cleaning casement. A roller rod aperture is defined through the end wall and is dimensioned to encircle a wire rod of a paint roller assembly.

In other embodiments, a trap protrudes from an inner wall of the cleaning casement and extends along a longitudinal length of the inner wall. The trap may be angled in a counterclockwise orientation relative to a clockwise rotation of the roller brush carried in the cleaning casement. The trap may be angled at an offset from a longitudinal axis of the cleaning casement.

In other embodiments, a roller stabilizer protrudes into the cleaning casement and is dimensioned to at least partially encircle the roller brush.

In other embodiments, a solvent exhaust is fitted at a second end of the cleaning casing.

In yet other embodiments, the cleaning solvent is water and the coupling is a garden hose connector.

These and other features, aspects and advantages of the present invention will become better understood with reference to the following drawings, description and claims.

DETAILED DESCRIPTION

Figure 1:
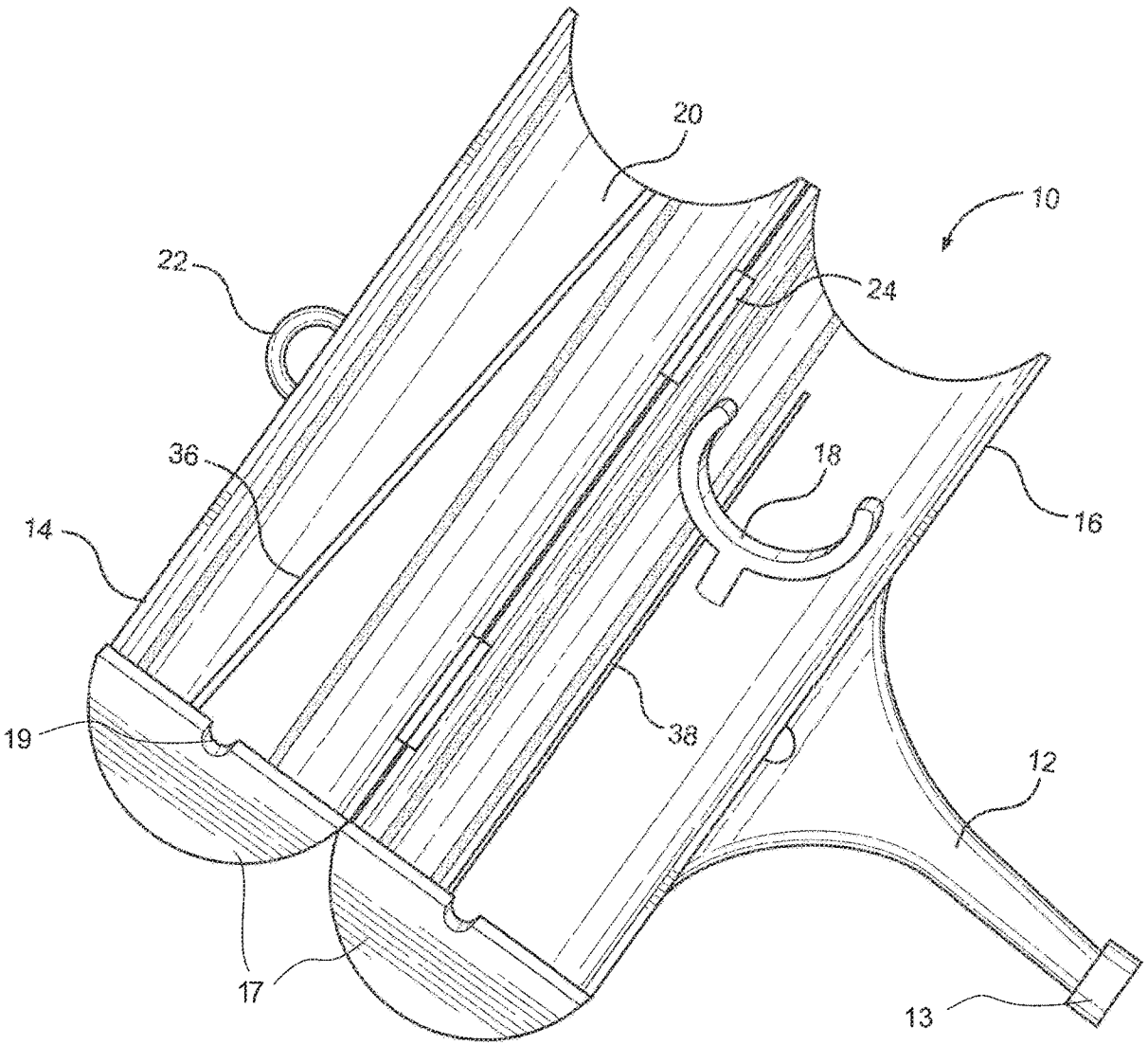
FIG. 1 is a perspective view of the roller brush cleaning apparatus.
Figure 2:
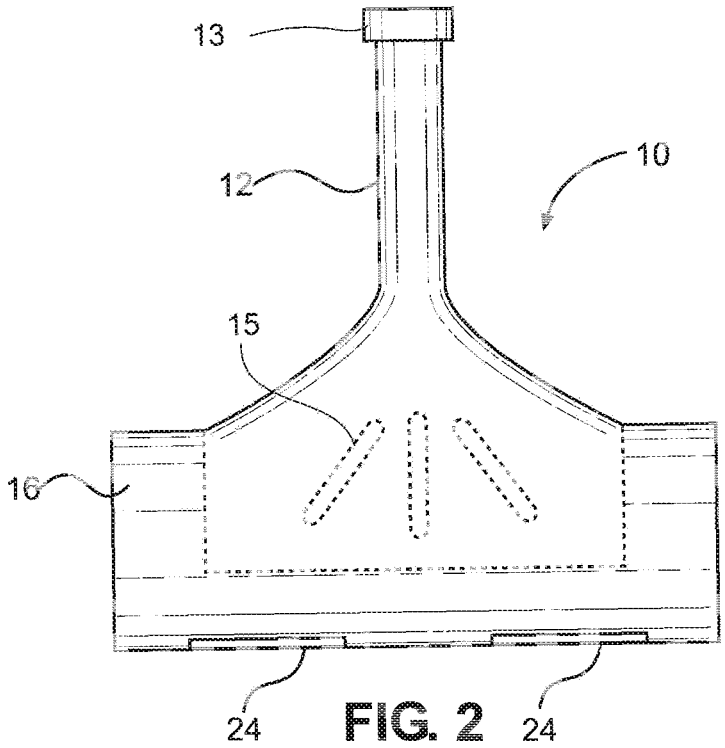
FIG. 2 is a top view of the roller brush cleaner.
Figure 3:
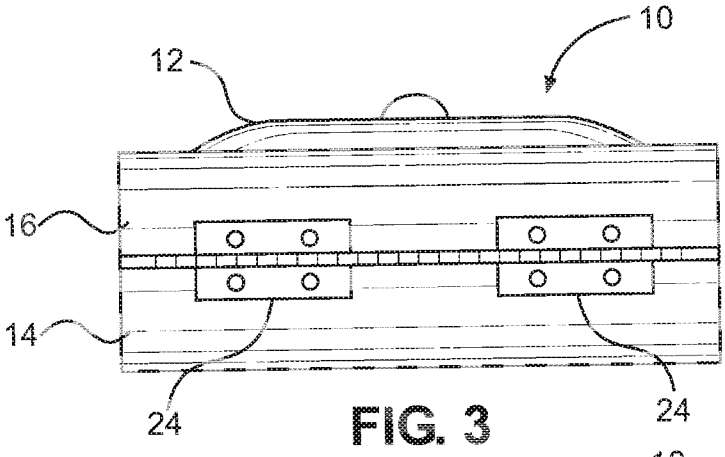
FIG. 3 is a front view of the roller brush cleaner.
Figure 4:
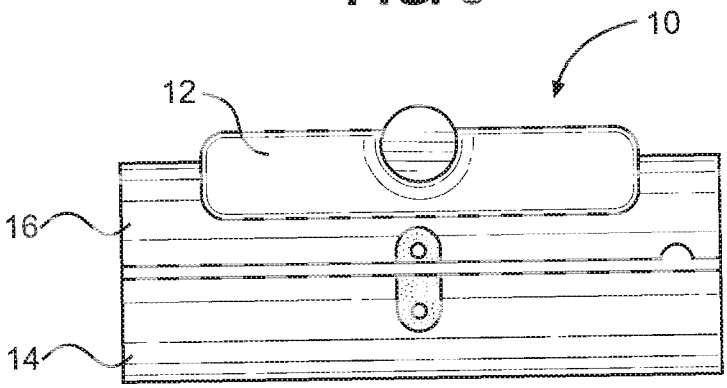
FIG. 4 is a rear view of the roller brush cleaner.
Figure 5:
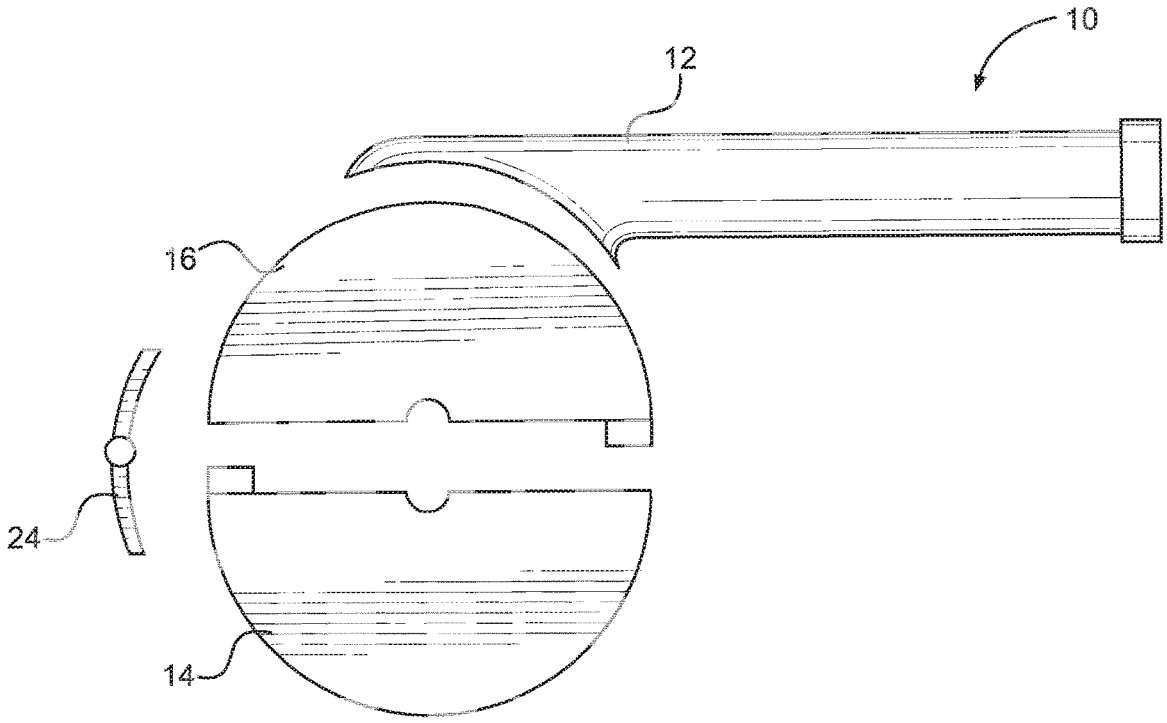
FIG. 5 is a right side exploded view of the roller brush cleaner.
Figure 6:
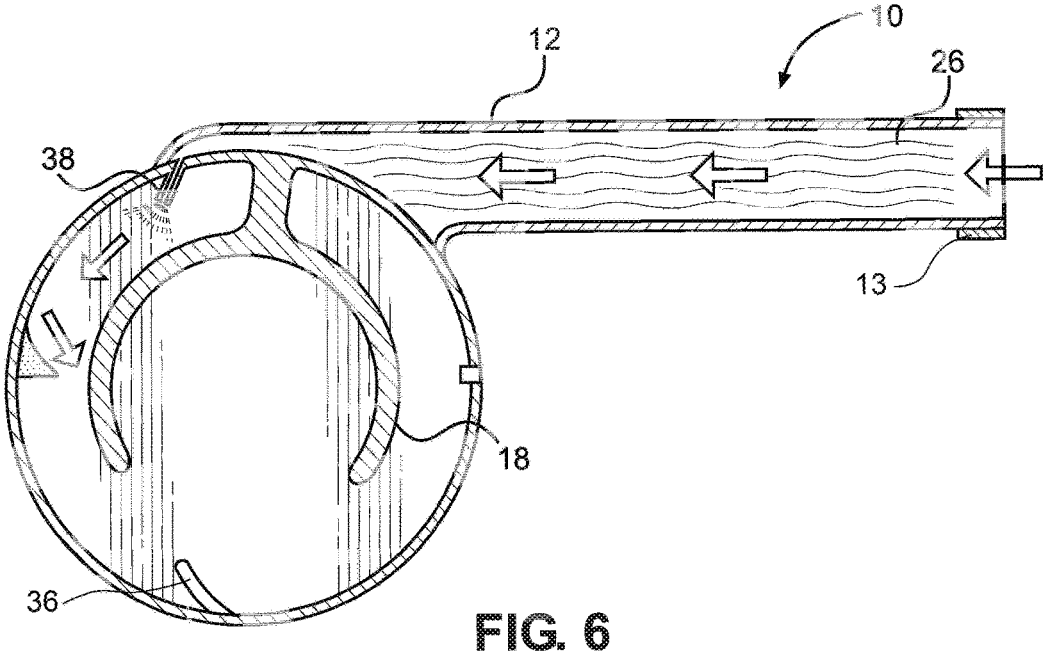
FIG. 6 is a right side cross section view of the roller brush cleaner.
Figure 7:
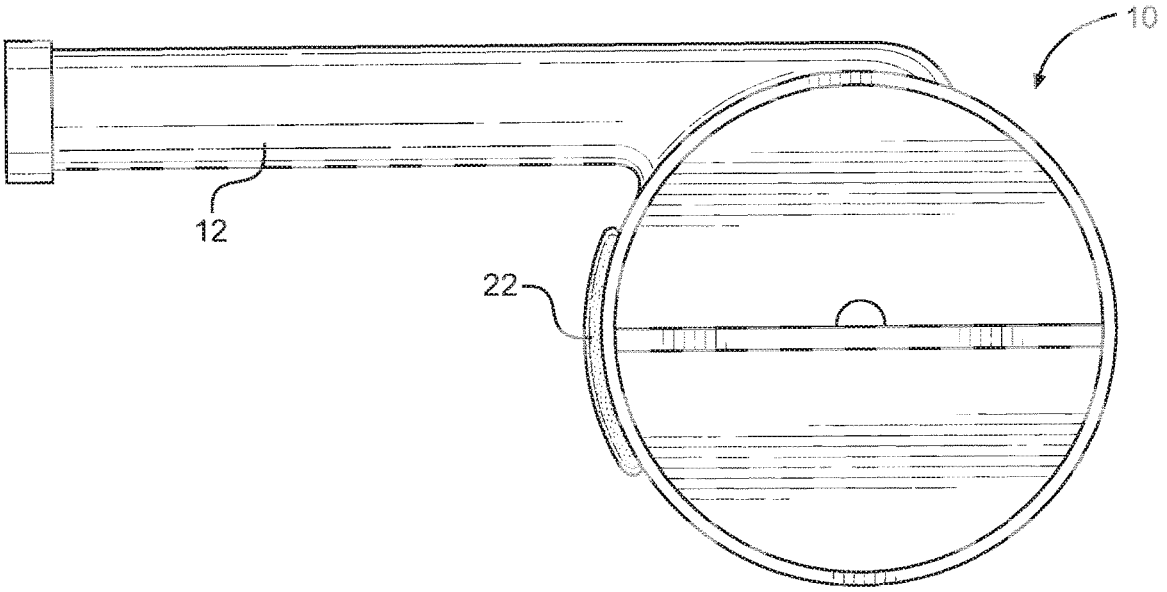
FIG. 7 is a left side view of the roller brush cleaner

The following detailed description is of the best currently contemplated modes of carrying out exemplary embodiments of the invention. The description is not to be taken in a limiting sense, but is made merely for the purpose of illustrating the general principles of the invention.

Broadly, embodiments of the present invention provides an apparatus and method for cleaning a paint roller. The paint roller cleaner is configured to direct a jet of a cleaning solution, such as water for water-based coating compositions, against a roller applicator brush. The jet induces a rotation of the roller applicator brush such that the water and the coating composition are dissolved and slung from the roller applicator brush by centrifugal forces developed by the rotation of the roller applicator brush.

As seen in reference to the drawings of FIGS. 1-8, the paint roller cleaner 10 includes a handle 12 having a first end, a second end, and an internal channel defined by at least one sidewall. The first end of the handle 12 has a coupling 13 for attachment to a pressurized source of a cleaning solution 26. For water-based coating compositions, such as latex paint, the cleaning solution 26 is water and the pressurized source may be a conventional garden hose. In this case, the coupling 13 is a standard garden hose fitting.

The handle 12 includes an interior channel to communicate the cleaning solution 26 from the coupling 13 at the first end to the second end of the handle 12. The handle 12 may include an intermediate section that is dimensioned to be gripped by a user's hand. The at least one sidewall of the handle 12 diverges outwardly between the intermediate section and the second end. The second end defines a splayed structure to direct the solvent 26 at a majority of a longitudinal length of the roller brush 30. A plurality of guide vanes 15 are disposed in a spaced apart relation within the splayed end. The plurality of guide vanes 15 protrude from the at least one sidewall and are oriented to direct a stream of the cleaning solution 26 through at least one jet spray nozzle 38 extending across a longitudinal length of the paint roller brush 30 carried within a cleaning casing.

The cleaning casing defines a generally cylindrical interior cavity 20. The cleaning casing is dimensioned to surround the paint roller brush 30 such that an inner wall of the casing is spaced apart from an applicator surface of the roller brush. The cleaning casing may include a top casing segment 14 and a bottom casing segment 16 that are connected by a hinge element 24. An end wall 17 is defined at a first end of the cleaning casing. A roller rod aperture 19 is defined through the end wall 17 and is dimensioned to encircle a wire rod 28 of the paint roller assembly. A fastener 22 is provided to secure the top casing segment 14 and the bottom casing segment 16 in a closed configuration about the brush roller 30.

Preferably, the splayed end is coupled to the cleaning casing perpendicular to a longitudinal length of the casing. The splayed end may also be offset from a rotational axis of the roller brush 30 carried on the wire rod 28 of the paint roller assembly. The at least one jet spray nozzle 38 may be a slot defined in a length of the casing. In alternative embodiments, the at least one spray jet nozzle 38 may include a plurality of spray jet nozzles 38 disposed in a spaced apart relation along the longitudinal length of the cleaning casing. The at least one jet spray nozzle 38 is oriented to direct the cleaning solvent 26 substantially tangentially to a circumferential aspect of the brush roller 30.

In some embodiments, a roller stabilizer 18 may protrude into the cleaning casing and is dimensioned to at least partially encircle the paint roller brush 30. The roller stabilizer 18 is provided to correct a rotational imbalance of the roller brush 30 as it spins within the cleaning casing. The rotational imbalance may be introduced by an uneven collection or pooling of the coating material that is carried in the roller brush 30.

A second end of the cleaning casing has an opening such that the cleaning solution 36 and dissolved paint compositions may be released from within the casing. In some embodiments, a funnel like solvent exhaust 34 may be fitted at the second end to orient the solvent and dissolved paint compositions into a containment vessel, such as a bucket.

In some embodiments, a trap 36 protrudes from the inner wall of the cleaning casement into the interior cavity 20 along a longitudinal length of the inner wall. The trap 36 may be angled in a counterclockwise orientation relative to a rotation of the roller brush 30 carried in the cleaning casing of the paint roller cleaner 10. The trap 36 may also angled at an offset from the longitudinal axis of the cleaning casing. The trap 36 is oriented to catch impurities that are slung from the paint roller 30 during cleaning, and direct the impurities, coating material, and solvent 36 towards the second end of the cleaning casing.

Figure 8:
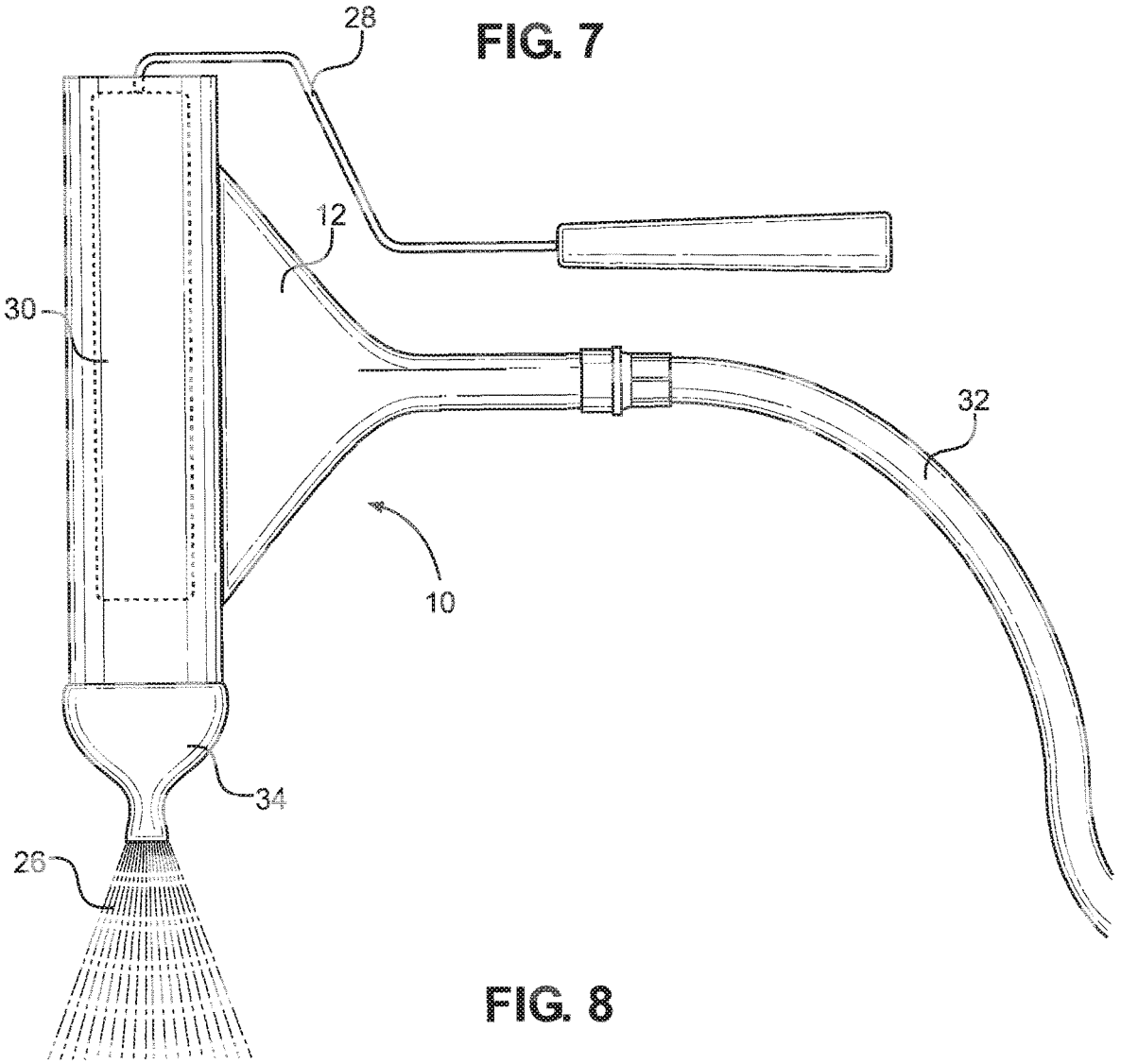
FIG. 8 is a top in-use view of the roller brush cleaner.

As best seen in reference to FIG. 8, a method of cleaning a coating material from a roller brush 30 may be seen. The method includes securing the roller brush 30 within the cleaning casing of the paint roller cleaner 10 with the wire rod 28 of the roller brush assembly protruding from the roller rod aperture 19 at the first end of the cleaning casing.

A pressurized source of a solvent 26, such as a garden hose 32 is operatively attached to the coupling 13. The pressurized source is activated to communicate the solvent 26 through the handle 12 where the solvent is tangentially directed by the at least one spray jet nozzle 38 against the circumferential aspect of the roller brush 30 to rotationally propel the roller brush 30 and eject the solvent 26 at the roller brush 30.

The method may also include collecting a discharge of the solvent 26 and coating material from a second end of the cleaning casement. The collecting may be facilitated with the application of the solvent exhaust 34 to the second end of the cleaning casement. The collecting may also be facilitated by providing the trap 36 within the cleaning casing to collect and direct the discharge to the second end of the cleaning casement.

It should be understood, of course, that the foregoing relates to exemplary embodiments of the invention and that modifications may be made without departing from the spirit and scope of the invention as set forth in the following claims.

What is claimed is:

1. A roller brush cleaning apparatus, comprising:

a handle having a coupling at a first end, the coupling configured to connect to a pressurized source of a cleaning solvent, an interior cavity defined by at least one sidewall to communicate the cleaning solvent to a splayed end of the handle;

a cleaning casement coupled to the splayed end, the cleaning casement configured to surround a roller brush for rotation of the roller brush within the cleaning casement;

a roller stabilizer protruding into the cleaning casement and dimensioned to at least partially encircle the roller brush; and at least one jet spray nozzle interposed between the splayed end and the cleaning casement, the at least one jet spray nozzle communicating the cleaning solvent from the splayed end into the cleaning casement, the at least one jet spray nozzle oriented to tangentially direct the cleaning solvent against a circumferential aspect of the roller brush.

2. The roller brush cleaning apparatus of claim 1, further comprising:

a plurality of guide vanes protruding into the interior cavity to direct the cleaning solvent across the splayed end.

3. The roller brush cleaning apparatus of claim 1, the cleaning casement further comprising:

a top casing segment and a bottom casing segment interconnected by a hinge element to selectively open and close the cleaning casement about the roller brush.

4. The roller brush cleaning apparatus of claim 3, further comprising:

an end wall defined at a first end of the cleaning casement; and a roller rod aperture defined through the end wall and dimensioned to encircle a wire rod of a paint roller assembly.

5. The roller brush cleaning apparatus of claim 4, further comprising:

a trap protruding from an inner wall of the cleaning casement and extending along a longitudinal length of the inner wall.

6. The roller brush cleaning apparatus of claim 5, wherein the trap is angled in a counterclockwise orientation relative to a clockwise rotation of the roller brush carried in the cleaning casement.

7. The roller brush cleaning apparatus of claim 6, wherein the trap angled at an offset from a longitudinal axis of the cleaning casement.

8. The roller brush cleaning apparatus of claim 1, further comprising:

a roller stabilizer protruding into the cleaning casement at a mid-point of the casement.

9. The roller brush cleaning apparatus of claim 1, further comprising:

solvent exhaust fitted at a second end of the cleaning casement.

10. The roller brush cleaning apparatus of claim 1, wherein the cleaning solvent is water and the coupling is a garden hose connector.

* * * * *